US007007503B2

(12) United States Patent
Takashi

(10) Patent No.: US 7,007,503 B2
(45) Date of Patent: Mar. 7, 2006

(54) OIL EQUALIZING SYSTEM FOR MULTIPLE COMPRESSORS

(75) Inventor: Kaneko Takashi, Yokohami (JP)

(73) Assignee: Samsung Electronics Co., Ltd., Suson-si (KR)

( * ) Notice: Subject to any disclaimer, the term of this patent is extended or adjusted under 35 U.S.C. 154(b) by 0 days.

(21) Appl. No.: 10/890,371

(22) Filed: Jul. 14, 2004

(65) Prior Publication Data

US 2005/0072183 A1 Apr. 7, 2005

(30) Foreign Application Priority Data

Aug. 29, 2003 (JP) ..... 2003-307012

(51) Int. Cl.
*F25B 43/02* (2006.01)

(52) U.S. Cl. ..... 62/468; 62/510

(58) Field of Classification Search ..... 62/468, 62/510, 228.5, 196.3, 193; 417/295, 427, 417/372
See application file for complete search history.

(56) References Cited

U.S. PATENT DOCUMENTS 4,741,674 A * 5/1988 Tischer ..... 417/295
5,996,363 A * 12/1999 Kurachi et al. ..... 62/192
6,453,691 B1 * 9/2002 Seo et al. ..... 62/228.5
6,722,156 B1 * 4/2004 Tanimoto et al. ..... 62/510

FOREIGN PATENT DOCUMENTS

JP 411063691 A * 3/1999

* cited by examiner

*Primary Examiner*—Melvin Jones
(74) *Attorney, Agent, or Firm*—Staas & Halsey LLP

(57) ABSTRACT

An oil equalizing system for multiple compressors which does not require a particular machining process for shells of the compressors, thereby being capable of preventing an increase in costs, while maintaining oil in each compressor in a proper amount. In a refrigerant circuit, in which at least three compressors are connected in parallel, the oil equalizing system includes an oil equalizing tube adapted to communicate shells of the compressors with one another, and a bypass tube adapted to connect the oil equalizing tube to a discharge side refrigerant line for the compressors. The shell of each compressor is directly communicated with the shell of each of the remaining compressors by the oil equalizing tube.

3 Claims, 2 Drawing Sheets

OIL EQUALIZING SYSTEM FOR MULTIPLE COMPRESSORS

CROSS-REFERENCE TO RELATED APPLICATION

This application claims the benefit of Japanese Patent Application No. 2003-307012, filed on Aug. 29, 2003 in the Japanese Patent Office, the disclosure of which is incorporated herein by reference.

BACKGROUND OF THE INVENTION

1. Field of the Invention

The present invention relates to an oil equalizing system for multiple compressors used in an air conditioner or the like which is capable of maintaining a proper amount of oil in each compressor.

2. Description of the Related Art

As an example of one type of air conditioner, there is a so-called "multi-type air conditioner in which a plurality of compressors are provided in one outdoor unit, in order to cope with a plurality of indoor units.

For the multiple compressors provided in the outdoor unit of such an air conditioner, variable capacity compressors may be used. In some cases, such compressors may have different capacities of compressor shells thereof.

In such cases, where compressors communicate via an oil equalization tube, oil may flow from the shell of the high pressure side compressor to the low pressure side compressor. In this case, the oil flows continuously, even when the level thereof in the shell of the high pressure side compressor is lowered below the position of oil equalizing tube connectors. This is because the oil is present in a mist state as it is stirred by rotating elements in the shell of the high pressure side compressor. As a result, shortage of oil in the high pressure side compressor may occur.

In order to prevent such a flow of oil mist, a proposal has been made, in which the shells of multiple compressors are communicated via an oil equalizing tube, and the oil equalizing tube is connected to a discharge side refrigerant line of the compressors via a bypass tube, as disclosed in Japanese Laid-open Publication No. Heisei 04-222354.

The oil equalizing system for multiple compressors disclosed in the above publication will be described in brief. As shown in FIG. 2, in a refrigerant circuit Ka, three compressors 1, 2 and 3 are connected to a discharge side refrigerant line 5, and a suction side refrigerant line 6, such that the compressors are connected in parallel. Respective compressors 1, 2 and 3 include shells 1*a*, 2*a* and 3*a*, adjacent ones of which are communicated via an oil equalizing tube 7. The discharge side refrigerant line 5 of the compressors 1, 2 and 3 is connected to the oil equalizing tubes 7 via a bypass tube 9, which is provided with an opening/closing valve 8 at an intermediate portion thereof.

In accordance with this oil equalizing system, the opening/closing valve 8 is open during normal cooling/heating operation so that high pressure refrigerant gas is introduced into the oil equalizing tubes 7 via the bypass tube 9. Accordingly, it is possible to prevent oil mist from flowing between adjacent compressor shells 1*a*, 2*a* and 3*a* through the associated oil equalizing tube 7, and thus, to prevent shortage of oil in the high pressure compressor.

Where there is an oil amount difference among the compressor shells 1*a*, 2*a* and 3*a* due to a prolonged compressor operation, a so-called "oil equalizing operation" is carried out. That is, the compressors 1, 2 and 3 are sequentially operated one by one with the opening/closing valve 8 closed, thereby causing surplus oil in each of the compressors 1, 2 and 3 to be sequentially fed. Thus, the amount of oil in each of the compressor shells 1*a*, 2*a* and 3*a* is returned to a proper value.

However, the conventional oil equalizing system for multiple compressors shown in FIG. 2 has various problems.

That is, the shell of the intermediate one of the three compressors 1, 2 and 3, that is, the compressor shell 2*a*, communicates with the shells 1*a* and 3*a* of the left and right compressors 1 and 3 via respective oil equalizing tubes 7, so that it is necessary to use two oil equalizing tube connectors. For this reason, a particular machining process is required for the compressor shell 2*a*, so that there is an increase in costs.

Furthermore, when the level of oil in the compressor 2 arranged at the middle side as viewed in FIG. 2 is lowered below the level of the oil equalizing tube connectors 10 while the compressor 1 arranged at the left side as viewed in FIG. 2 operates in the oil equalizing operation mode, in which the multiple compressors are sequentially operated one by one, only the refrigerant, which is introduced into the compressor 2 from the suction side refrigerant tube 6 connected to the compressor 2, is fed to the compressor 1, which is in operation, via the associated oil equalizing tube 7 (as indicated by a white arrow in FIG. 2). In this state, the oil of the compressor 3, which is arranged at the right side as viewed in FIG. 2, cannot reach the compressor 1, which is in operation. For this reason, there is a problem in that it is impossible to return the amount of oil in each of the compressor shells 1*a*, 2*a* and 3*a* to a proper value, even through the oil equalizing operation is carried out.

Meanwhile, although the left and right oil equalizing tubes 7 communicate by the bypass tube 9, no liquid oil can flow between the compressors via the bypass tube 9 because the bypass tube 9 has a diameter considerably smaller than that of the oil equalizing tubes 7.

SUMMARY OF THE INVENTION

The present invention has been made in view of the above-mentioned problems, and an aspect of the invention is to provide an oil equalizing system for multiple compressors which does not require a particular machining process for shells of the compressors, thereby being capable of preventing an increase in costs, while maintaining oil in each compressor in a proper amount.

In accordance with this aspect, this is accomplished by providing an oil equalizing system for multiple compressors in a refrigerant circuit, in which at least three compressors are connected in parallel, the oil equalizing system comprising an oil equalizing tube adapted to communicate shells of the compressors with one another, and a bypass tube adapted to connect the oil equalizing tube to a discharge side refrigerant line for the compressors, wherein the shell of each compressor is directly communicated with the shell of each of the remaining compressors by the oil equalizing tube.

The oil equalizing tube may comprise a main oil equalizing tube, which is common to all the compressors, and branched oil equalizing tubes, which connect the main oil equalizing tube to the shells of the compressors, respectively.

In the oil equalizing system for multiple compressors according to the present invention, the shell of each compressor is directly communicated with the shell of each of the remaining compressors via the oil equalizing tube. That is, the shell of each compressor can be communicated, through only the portion thereof connected to the oil equalizing tube, with the shell of each of the remaining compressors. Accordingly, even for the shell of the middle compressor, only one oil equalizing tube connector is required. Thus, it is possible to prevent an increase in the manufacturing costs of compressor shells, which may be incurred in the case in which a plurality of oil equalizing tube connectors are used.

Even when the level of oil in one of the multiple compressors is lowered below the level of the oil equalizing tube connectors while another compressor operates in the oil equalizing operation mode, in which the compressors are sequentially operated one by one, it is possible to allow flow of oil between the compressors without any interference by the refrigerant introduced from the suction side refrigerant line into the former compressor. Thus, it is possible to return the amount of oil in each of the compressor shells to a proper value.

In accordance with the oil equalizing system for multiple compressors in which the oil equalizing tube comprises a main oil equalizing tube, which is common to all the compressors, and branched oil equalizing tubes, which connect the main oil equalizing tube to the shells of the compressors, respectively, the configuration of the oil equalizing tube is simple, so that it is possible to achieve a simple conduit connecting task while achieving a reduction in costs without any difficulty.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
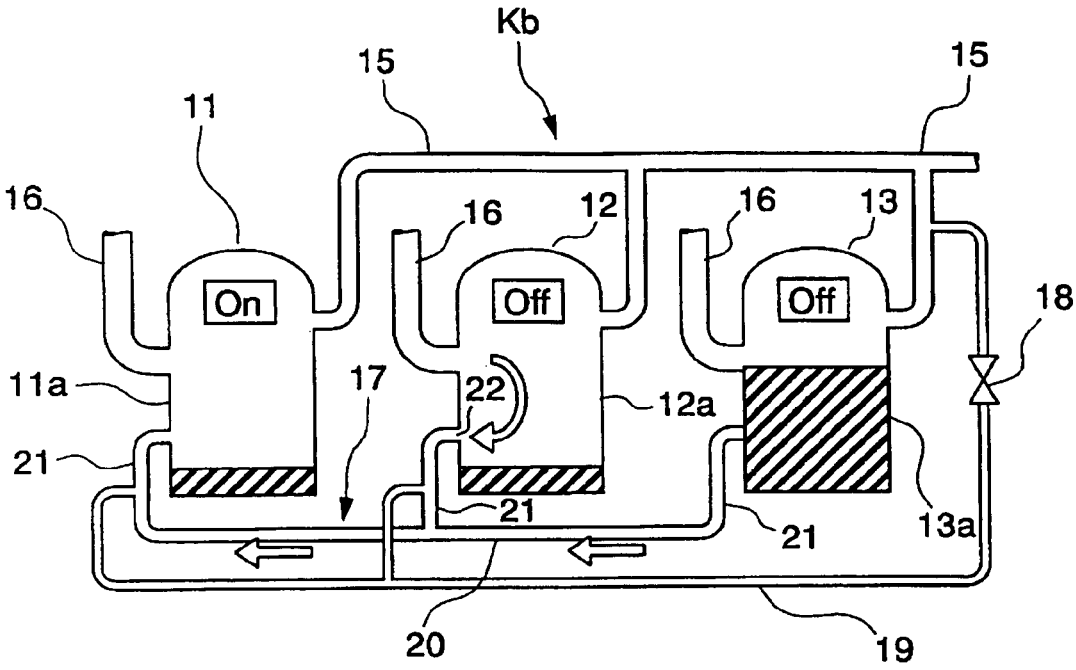
FIG. 1 is a schematic sectional view illustrating an oil equalizing system for multiple compressors according to an embodiment of the present invention.
Figure 2:
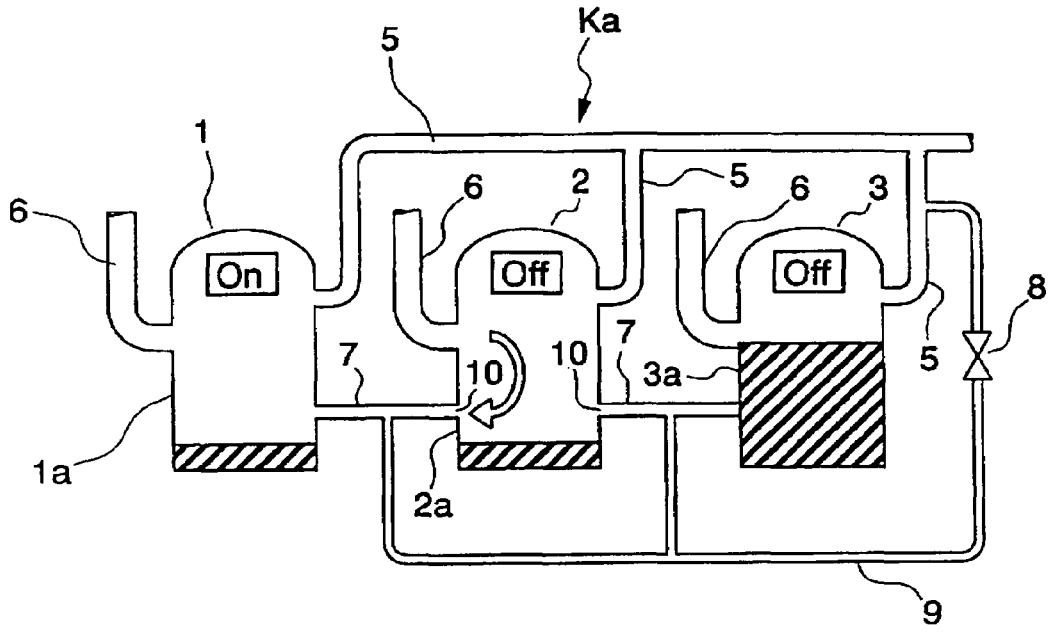
FIG. 2 is a schematic sectional view illustrating a conventional oil equalizing system for multiple compressors.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 illustrates an oil equalizing system for multiple compressors according to the present invention.

As shown in FIG. 1, in a refrigerant circuit Kb, three compressors 11, 12 and 13 are connected to a discharge side refrigerant line 15 and a suction side refrigerant line 16 such that the compressors are connected in parallel. Respective compressors 11, 12 and 13 include shells 11*a*, 12*a* and 13*a*, which directly communicate via an oil equalizing tube 17. The discharge side refrigerant line 15 of the compressors 11, 12 and 13 is connected to the oil equalizing tube 17 via a bypass tube 19, which is provided with an opening/closing valve 18 at an intermediate portion thereof. The compressors 11, 12 and 13 used in this case are low pressure shell type compressors.

The oil equalizing tube 17 includes a main oil equalizing tube 20, which is common to all the compressors 11, 12 and 13, and branched oil equalizing tubes 21, which connect the main oil equalizing tube 20 to the compressor shells 11*a*, 12*a* and 13*a*, respectively. The bypass tube 19, which extends from the discharge side refrigerant line 15, is connected to the branched oil equalizing tubes 21.

Meanwhile, the main oil equalizing tube 20 and branched oil equalizing tubes 21 may have the same diameter. Alternatively, the main oil equalizing tube 20 may have a diameter different from that of the branched oil equalizing tubes 21. Provided, these constituent elements of the oil equalizing tube each have a diameter considerably larger than that of the bypass tube 19.

In accordance with the oil equalizing system for multiple compressors having the above-described configuration, the opening/closing valve 18 is open during a normal cooling/heating operation so that high pressure refrigerant gas is introduced into the oil equalizing tube 17 via the bypass tube 19. Accordingly, it is possible to prevent flow of oil mist among the compressor shells 11*a*, 12*a* and 13*a* through the oil equalizing tube 17, and thus, to prevent shortage of oil in the high pressure one of the compressors 11, 12 and 13.

Where there is an oil amount difference among the compressor shells 11*a*, 12*a* and 13*a* due to a prolonged compressor operation, a so-called "oil equalizing operation" is carried out. That is, the compressors 11, 12 and 13 are sequentially operated one by one with the opening/closing valve 18 closed.

This will be described in more detail, in conjunction with an example in which the compressor 11 arranged at the left side as viewed in FIG. 1 operates in an oil equalizing operation mode. When the level of oil in the compressor 12 arranged at the middle side as viewed in FIG. 1 is lowered below the level of oil equalizing tube connectors 22 during the oil equalizing operation, the refrigerant, which is introduced into the compressor 12 from the suction side refrigerant tube 16 connected to the compressor 12, flows into the left compressor 11 in operation via the oil equalizing tube 17, as indicated by a white arrow in FIG. 1. Simultaneously, liquid oil present in the right compressor 13, which is arranged at the right side as viewed in FIG. 1, flows into the left compressor 11 because the right compressor 13 is directly communicated with the left compressor 11 via the oil equalizing tube 17.

In other words, even when the level of oil in one compressor, for example, the compressor 12, is lowered below the level of the oil equalizing tube connectors 22, it is possible to allow flow of oil from another compressor to the compressor, currently performing an oil equalizing operation, without any interference by the refrigerant introduced from the suction side refrigerant line 16 into the compressor 12. Thus, it is possible to return the amount of oil in each of the compressor shells 11*a*, 12*a* and 13*a* to a proper value.

Also, the shell of each compressor is directly communicated with the shell of each of the remaining compressors via the oil equalizing tube 17. That is, the shell of each compressor can communicate, through only the portion thereof connected to the oil equalizing tube, with the shell of each of the remaining compressors. Accordingly, even for the shell of the middle compressor, only one oil equalizing tube connector 22 is required. Thus, it is possible to prevent an increase in the manufacturing costs of compressor shells, which may be incurred in the case in which a plurality of oil equalizing tube connectors are used.

Meanwhile, although three compressors are arranged in the above-described embodiment, the number of compressors is not limited thereto. Alternatively, four or more compressors may be used.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An oil equalizing system for multiple compressors in a refrigerant circuit, in which at least three compressors are connected in parallel, the oil equalizing system comprising an oil equalizing tube adapted to communicate shells of the compressors with one another, and a bypass tube adapted to connect the oil equalizing tube to a discharge side refrigerant line for the compressors, wherein the shell of each compressor is directly communicated with the shell of each of the remaining compressors by the oil equalizing tube.

2. The oil equalizing system according to claim 1, wherein the oil equalizing tube comprises:

a main oil equalizing tube, which is common to all the compressors; and branched oil equalizing tubes, which connect the main oil equalizing tube to the shells of the compressors, respectively.

3. The oil equalizing system according to claim 1, the bypass tube has the same diameter of the oil equalizing tube.

* * * * *